US007225780B2

(12) United States Patent
Khami et al.

(10) Patent No.: US 7,225,780 B2
(45) Date of Patent: Jun. 5, 2007

(54) MODULAR RESONATOR

(75) Inventors: Roger J. Khami, Troy, MI (US); Mark D. Hellie, Westland, MI (US); William A. Rohrer, Ann Arbor, MI (US); Christopher E. Shaw, Canton, MI (US); David J. Moenssen, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 257 days.

(21) Appl. No.: 11/106,749

(22) Filed: Apr. 15, 2005

(65) Prior Publication Data

US 2006/0231054 A1 Oct. 19, 2006

(51) Int. Cl.
*F02M 35/10* (2006.01)

(52) U.S. Cl. ..... 123/184.57; 181/229

(58) Field of Classification Search ..... 123/184.57; 181/224, 229

See application file for complete search history.

(56) References Cited

U.S. PATENT DOCUMENTS

| | | | | |
|---|---|---|---|---|
| 4,546,733 | A | 10/1985 | Fukami et al. | |
| 5,040,495 | A | 8/1991 | Harada et al. | |
| 5,056,472 | A | 10/1991 | Kurokawa et al. | |
| 5,107,800 | A | 4/1992 | Araki et al. | |
| 5,116,231 | A | 5/1992 | Oki et al. | |
| 5,147,987 | A | 9/1992 | Richardson et al. | |
| 5,333,576 | A | 8/1994 | Verkleeren | |
| 5,349,141 | A * | 9/1994 | Horibe et al. | 181/229 |
| 5,647,314 | A | 7/1997 | Matsumura et al. | |
| 5,839,405 | A | 11/1998 | Falkowski et al. | |
| 6,009,705 | A | 1/2000 | Arnott et al. | |
| 6,067,953 | A | 5/2000 | Bloomer | |
| 6,098,586 | A | 8/2000 | Bloomer | |
| 6,105,547 | A | 8/2000 | Sakamoto et al. | |
| 6,422,192 | B1 | 7/2002 | Bloomer | |
| 6,508,331 | B1 | 1/2003 | Stuart | |
| 6,530,984 | B2 | 3/2003 | Stuart | |
| 6,698,390 | B1 | 3/2004 | Kostun et al. | |
| 6,719,078 | B2 | 4/2004 | Nakamura | |
| 6,732,509 | B2 | 5/2004 | Shiga | |
| 6,758,182 | B2 | 7/2004 | Nomizo et al. | |
| 6,758,304 | B1 | 7/2004 | McLean | |
| 6,792,907 | B1 | 9/2004 | Kostun et al. | |
| 2004/0065288 | A1 | 4/2004 | Kino et al. | |
| 2004/0134460 | A1 | 7/2004 | Kino et al. | |

FOREIGN PATENT DOCUMENTS

| | | |
|---|---|---|
| EP | 0 065 076 B1 | 9/1986 |
| JP | 3107522 | 5/1991 |

* cited by examiner

*Primary Examiner*—Noah P. Kamen
(74) *Attorney, Agent, or Firm*—Brinks Hofer Gilson & Lione

(57) ABSTRACT

A modular air induction system for a vehicle is provided. The air induction system includes a housing, a partition, and a plurality of holding members. The housing defines a chamber and includes an opening in fluid communication with the chamber. A partition is located within the housing to separate the chamber into a first and second volume thereby changing attenuation characteristics of the chamber. The partition is fixed within the chamber by at least one first holding member, thereby defining a first partition location. In addition, at least one second holding member is located within the housing and is adapted to receive the partition, thereby defining a second partition location.

17 Claims, 4 Drawing Sheets

MODULAR RESONATOR

BACKGROUND

1. Field of the Invention

The present invention generally relates to a modular resonator.

2. Description of Related Art

Typical air induction systems include an air inlet tube, an air box, and a clean air tube. Many of these air induction systems also contain hardware to address 1) noise attenuation, 2) filtration, 3) flow performance and sometimes 4) emission control. Noise attenuation is typically addressed with the use of resonators and by the sizing of the inlet orifice. Filtration is addressed by the design of the filter element, the treatment applied to that media, and the material used for that media. Flow performance is addressed by the sizing of the inlet orifice and the overall geometry of the air induction system. Emission control is addressed by inserting hydrocarbon adsorbing materials directly into the flow stream of the induction system (or parallel to the stream in LEV II cases). Devices for these four types of functional attributes are designed specifically for an individual combination of the engine, intake manifold, and vehicle. In addition, the packaging of the devices may be further varied to accommodate the under hood environment of the vehicle. However, a vehicle often has more than one engine or intake manifold available based on the vehicle powertrain options. The various powertrain options may have different performance characteristics, which may drive the need for powertrain-specific air induction system designs. Also, a common powertrain may be used in different vehicle applications with different functional requirements. As such, a new unique system is packaged for each additional application and powertrain option.

Air induction systems typically have resonators added to either or both the inlet and outlet ducts to address engine induction noise. However, the standing waves within the air box may not be adequately addressed due to the location of these resonators in the induction system. The orifice size of the inlet tube controls the overall noise emitted from the air induction system and also influences flow restriction for the system. To reduce flow restriction, the inlet orifice is generally increased. However, a large inlet orifice also increases noise levels. Therefore, there is a tradeoff between the flow, noise levels, and package availability. The filtration needs for a specific powertrain option are dependent primarily on the maximum air flow rate of the engine and the expected driving conditions of the end customer. The maximum air flow rate is directly related to the displacement of the engine. Therefore, the filtration requirements may be powertrain-specific. Emission control as it relates to air induction system design may also be different for one specific powertrain option or vehicle compared to another.

In view of the above, it is apparent that there exists a need for an improved modularity in air induction system design.

SUMMARY

In satisfying the above need, as well as overcoming the enumerated drawbacks and other limitations of the related art, the present invention provides an air induction system with modular sound tuning, filtration, flow performance and emission control.

The modular air induction system accommodates for the needs of multiple powertrain or vehicle options while using a common housing. The noise, filtration, flow, and emission performance is optimized within the common housing for each powertrain or vehicle option. As such, it utilizes package space more efficiently than multiple independent components. Further, the number of separate components required is reduced by using modular partitions inserted into the plurality of pre-located holding members within the housing. The housing has a lower base which may be molded. The holding members may be slots or tabs located at predetermined positions and molded into the walls of the housing. The partitions may be inserted into the slots to divide or connect chamber volumes, which in turn define the performance characteristics of the system. For example, if there are two different engine applications and each requires unique sound tuning, then there may be two different positions for each partition defined by the holding members. Further, each partition may have a hole or connecting tube through the partition where each hole or connecting tube may have a different neck diameter or length to produce unique tuning characteristics.

The chambers formed by the internal partitions can be tuned differently by varying a position and characteristics of the partitions. For example, the tuning volume of each chamber may be changed by the position of the partition. Further, each partition may have a hole or multiple holes and may be accompanied by a connecting tube extending from the partition. The diameter of the opening and the length of the connector tube may also be used to change the attenuating characteristics of the chamber.

The internal partitions of the housing would be located to appropriately form the interface for each powertrain-specific filter option. Each module would use the same housing, except one module may have a cover that is removable for a serviceable filter element, and a long life application may have a permanently welded cover. For example, a smaller displacement engine may require the use of a long life filter, but a larger displacement engine may require a serviceable filter.

Another partition may also incorporate the inlet orifice. Multiple inlet orifice partitions can be designed for the flow restriction requirements of multiple powertrain options. For example, if there are two different engine applications with two separate flow restriction requirements, then there may be two different inlet orifice partitions that can be installed into the housing.

Lastly, to the modular AIS could accommodate multiple interfaces for different types of emission control devices. For example, an emission control device can be introduced into the cover of the modular AIS, into a separate chamber within the housing, onto the filter media, or into the clean air tube. The emission control devices can be interchangeable across the various vehicle and powertrain options depending on the emission requirements of each option.

It should be understood by one of ordinary skill in the art that the air induction system referred to herein may comprise a resonator, expansion chamber, filtering system, or a combination of the aforementioned elements.

Further objects, features and advantages of this invention will become readily apparent to persons skilled in the art after a review of the following description, with reference to the drawings and claims that are appended to and form a part of this specification.

DETAILED DESCRIPTION

Figure 1:
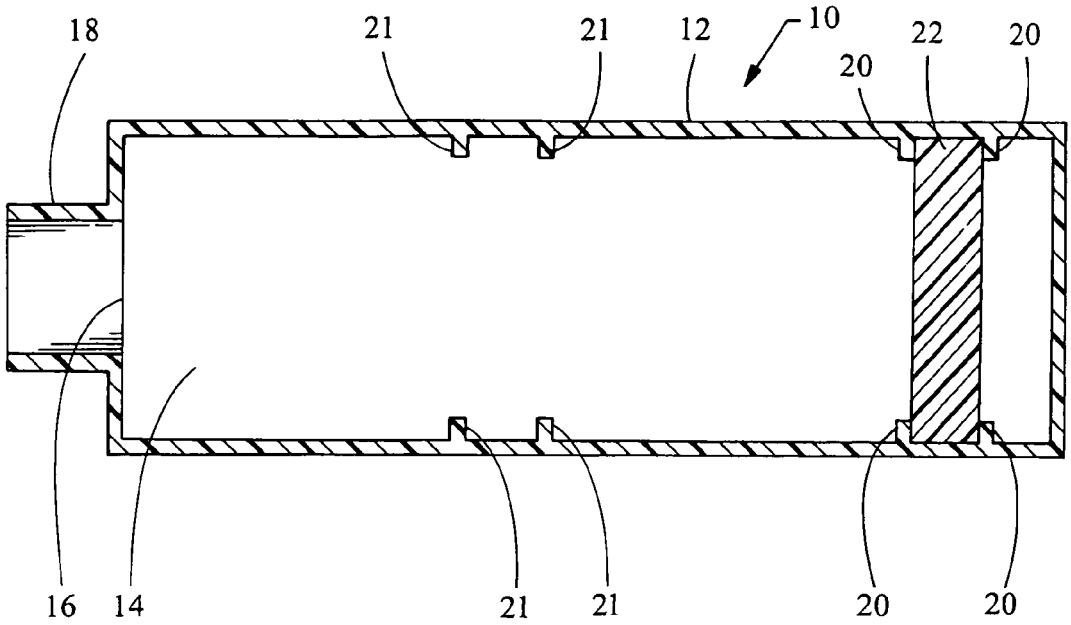
FIG. 1 is a sectional top view of a modular resonator in accordance with the present invention.

Referring now to FIG. 1, a resonator embodying the principles of the present invention is illustrated therein and designated at 10. As its primary components, the resonator 10 includes a housing 12, a partition 22, and a plurality holding members 20.

The resonator 10 includes a housing 12 forming a chamber 14. The housing 12 includes an inlet opening 16 allowing the inlet tube 18 to be in fluid communication with the chamber 14. Holding members 20 are attached to the inner wall of the housing 12. A partition 22 is fixed in place by a first set of the holding members 20, defining a first predefined location for the partition 22. A second set of holding members 21 are located at a different predefined location. The second set of holding members 21 are also configured to receive the partition 22, thereby forming a second predetermined location for the partition 22. By locating the partition 22 in either the first or second predetermined location, the attenuating characteristics of the resonator 10 may be modified. The holding members 20 and 21 may be tabs extending from the inner wall of the housing 12 or slots recessed into the inner wall of the housing 12. Tabs may be integrally molded into the wall of the housing, or alternatively may be fastened to the wall of the housing. A cover (not shown) may be attached over the housing 12 such that with the cover removed, the partitions 22 may be inserted into the holding members 20, and with the cover in place, the partition 22 is fixed within the holding members in all directions.

Figure 2:
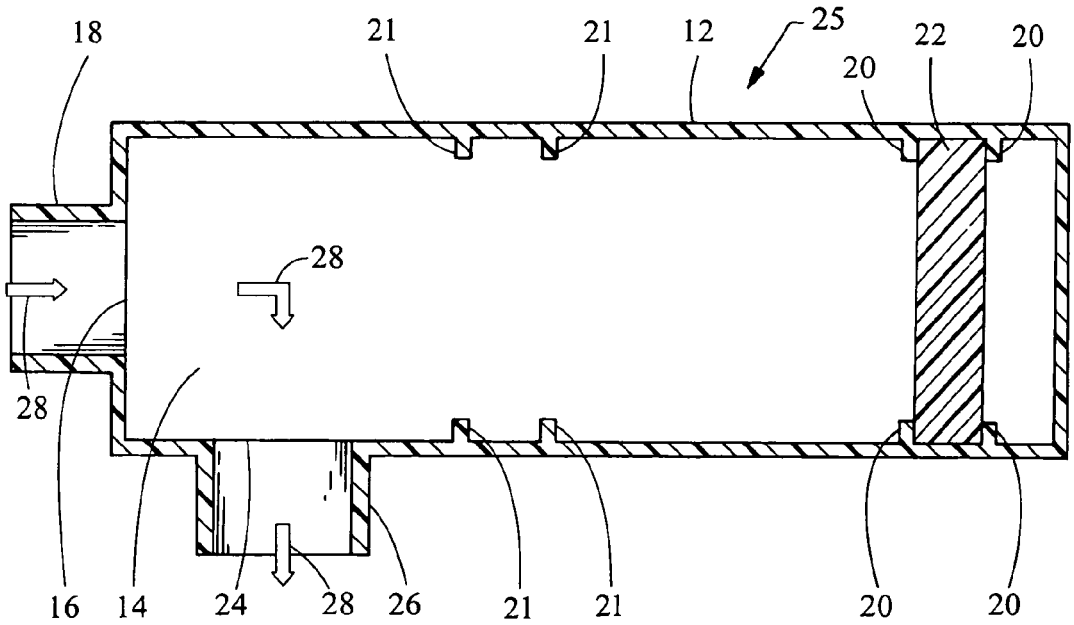
FIG. 2 is a sectional top view of an expansion chamber in accordance with the present invention.

Now referring to FIG. 2, the resonator of FIG. 1 has been expanded to form an expansion chamber 25. Similar components have been numbered consistent with the resonator in FIG. 1. Although, the housing 12 also includes an outlet opening 24 allowing the outlet tube 26 to be in fluid communication with the chamber 14. Further, arrows denoting the airflow path have been labeled with reference numeral 28.

Figure 3:
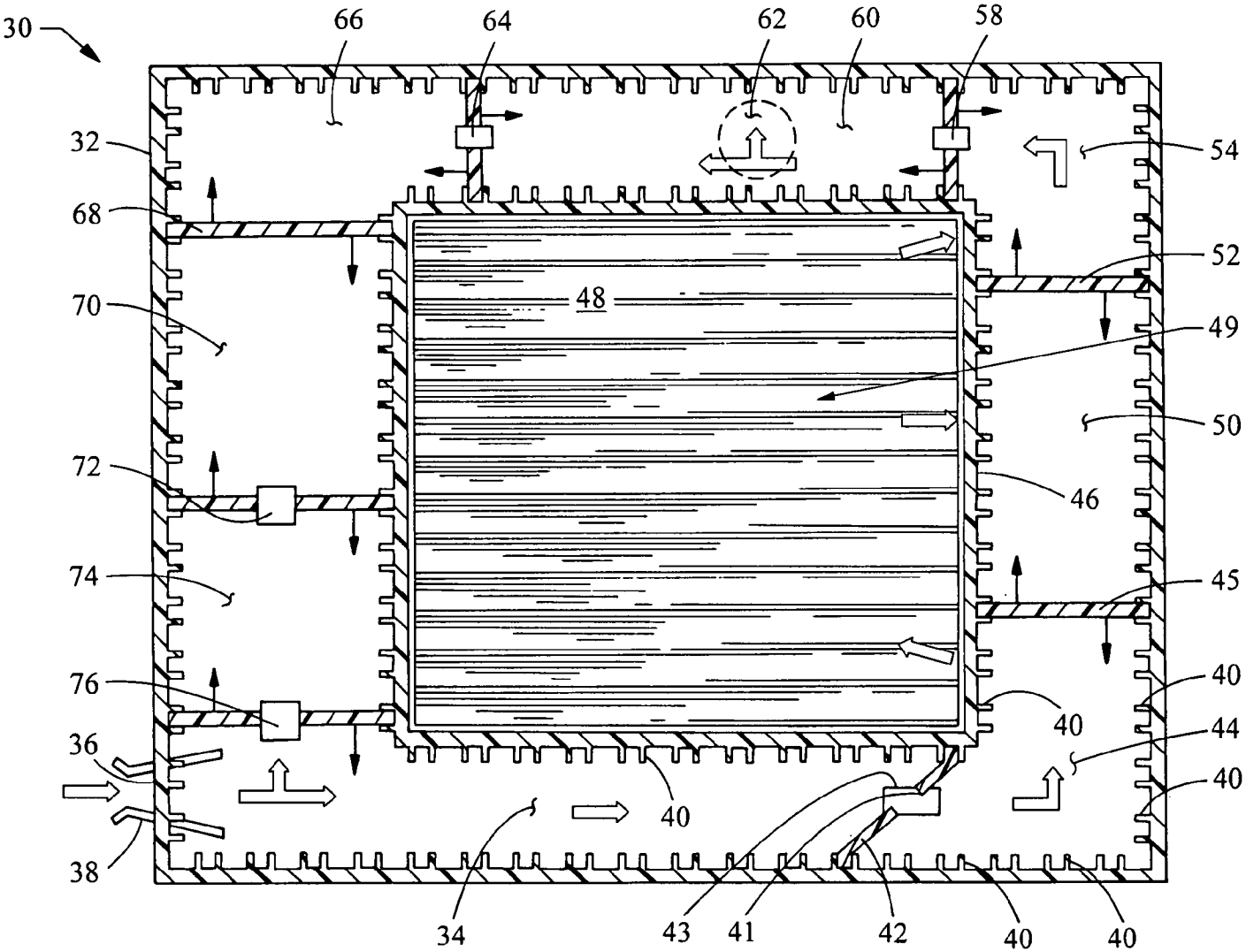
FIG. 3 is a sectional top view of another modular air induction system in accordance with the present invention.

Now referring to FIG. 3, the resonator and expansion chamber concepts of FIGS. 1 and 2 have been incorporated into an air induction system 30. The air induction system 30 includes a housing 32 that forms a chamber 34. An opening 36 in the housing 32 is in fluid communication with the chamber 34. The shape and volume of the chamber 34 may be varied to control the noise and air flow characteristics of the resonator 30. The opening 36 is located in an orifice plate 38. The orifice plate 38 may include a tube through the opening 36, as such, the size of the opening and length of the tube is sized for a desired air flow and noise control characteristics. The orifice plate 38 is interchangeable allowing different configurations for each engine package. A partition 42 is located within the chamber 34 and located by the holding members 40. The partition 42 has an opening 41 and a tube 43 extending from the opening 41. Various partitions may be used in place of partition 42 and located at additional predefined locations formed by the holding members 40. In addition, other partitions may have a different cross sectional area of the opening 41 or a different length of the tube 43. The partition 42 separates the chamber 34 into multiple volumes. Volume 44 is defined by the housing 32, partition 42 and partition 45. Partition 45 is a solid wall that is located by a set of holding members 40. However, additional sets of holding members 40 define multiple predefined positions for partition 45. Adjacent to partition 45 is a removable partition 46. Partition 46 is located between volume 44 and an air box 49. Partition 46 includes a plurality of perforations or holes allowing the volume 44 to be in fluid communication with air box 49. The air box 49 includes an air filter 48 which may be either a long life filter or a replaceable filter element. In addition, the air filter 48 may be treated for hydrocarbon emission control. The perforations may be varied such that the cross sectional area of individual openings or perforations may be different, in the portion of partition 46 that connects volume 44 to the air box 49, than the portion of the partition 46 that connects the air box 49 to the air box resonator volume 50.

The air box resonator volume 50 is in communication with the air box 49 through perforations or holes in partition 46. The volume of the air box resonator volume 50 is defined by the housing 32, and the predefined location of partition 45 and partition 52. Like partition 45, partition 52 is held in place by a first set of holding members 40. However, multiple locations for partition 52 are defined by the location of multiple sets of holding members 40. As such, partition 52 may be located at various predefined locations changing the volume of the air box resonator volume 50 to vary the attenuation characteristics thereof.

The air box 49 is also in communication with an outlet tube resonator volume 54 through holes or perforations in the partition 46. The volume of the outlet tube resonator volume 54 is defined by the housing 32, partition 52, and partition 58. Like partition 52, partition 58 is fixed by a set of holding members 40. In addition, multiple holding members 40 are located in predefined positions to define multiple predefined locations for the partition 58. As such, the volume of the outlet tube resonator volume 54 may be changed by moving partition 58 to another of the predefined locations, thereby changing the attenuating characteristics of the outlet tube resonator volume 54. Like partition 42, partition 58 includes an opening and a tube extending therethrough. As such, the outlet tube resonator volume 54 is in fluid communication with a primary outlet tube resonator volume 60 through partition 58. Further, a portion of the housing 32 or a cover (not shown) may include an opening 62 in fluid communication with the primary outlet tube resonator volume 60 allowing the primary outlet tube resonator volume 60 to be in fluid communication with an outlet tube 78. The volume of the primary outlet tube resonator volume 60 is defined by partition 58 and partition 64. Again, partition 64 is located and fixed in position by holding members 40 and multiple other holding members 40 define additional predetermined locations for partition 64. Partition 64 also includes an opening and a connector tube extending therefrom. Partition 64 therefore allows the primary outlet tube resonator volume 60 to be in fluid communication with another secondary outlet tube resonator volume 66. The volume of the secondary outlet tube resonator volume 66 is defined by the housing 32, partition 64, and partition 68. Partition 68 is located and fixed in place by holding members 40 which also define multiple predefined locations for partition 68. Partition 68 also defines the volume of a secondary inlet resonator chamber 70. The secondary inlet resonator chamber 70 is in fluid communication with a primary inlet resonator volume 74 through partition 72. Partition 72 includes an opening and connector extending from the opening, thereby facilitating the fluid communication of the secondary inlet resonator volume 70 and the primary inlet resonator volume 74. Partition 72 also defines the volume of both the secondary inlet resonator volume 70 and the primary inlet resonator volume 74. As such, the partition 72 is fixed by holding members 40 that also define multiple predefined locations for partition 72. Partition 76 includes an opening allowing the primary inlet resonator volume 74 to be in fluid communication with the chamber 34 to attenuate noise entering the inlet chamber 34.

Figure 4:
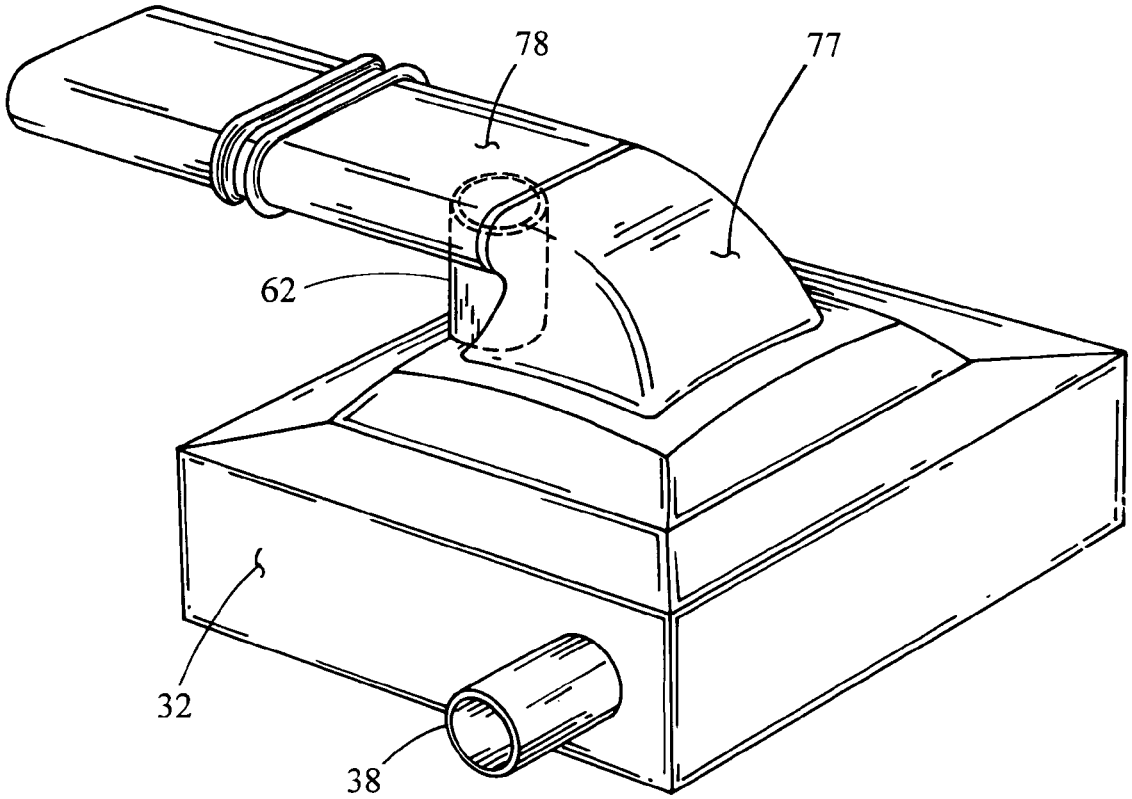
FIG. 4 is an isometric view of the modular air induction system in FIG. 3.

The air box 49 is in fluid communication with the outlet tube 78 through an opening formed in the cover 77. Other portions of the cover 77 serve to isolate the hole or fluid communication channel with the outlet tube 78 from various other volumes within the housing 32 as shown in FIG. 4.

Figure 5:
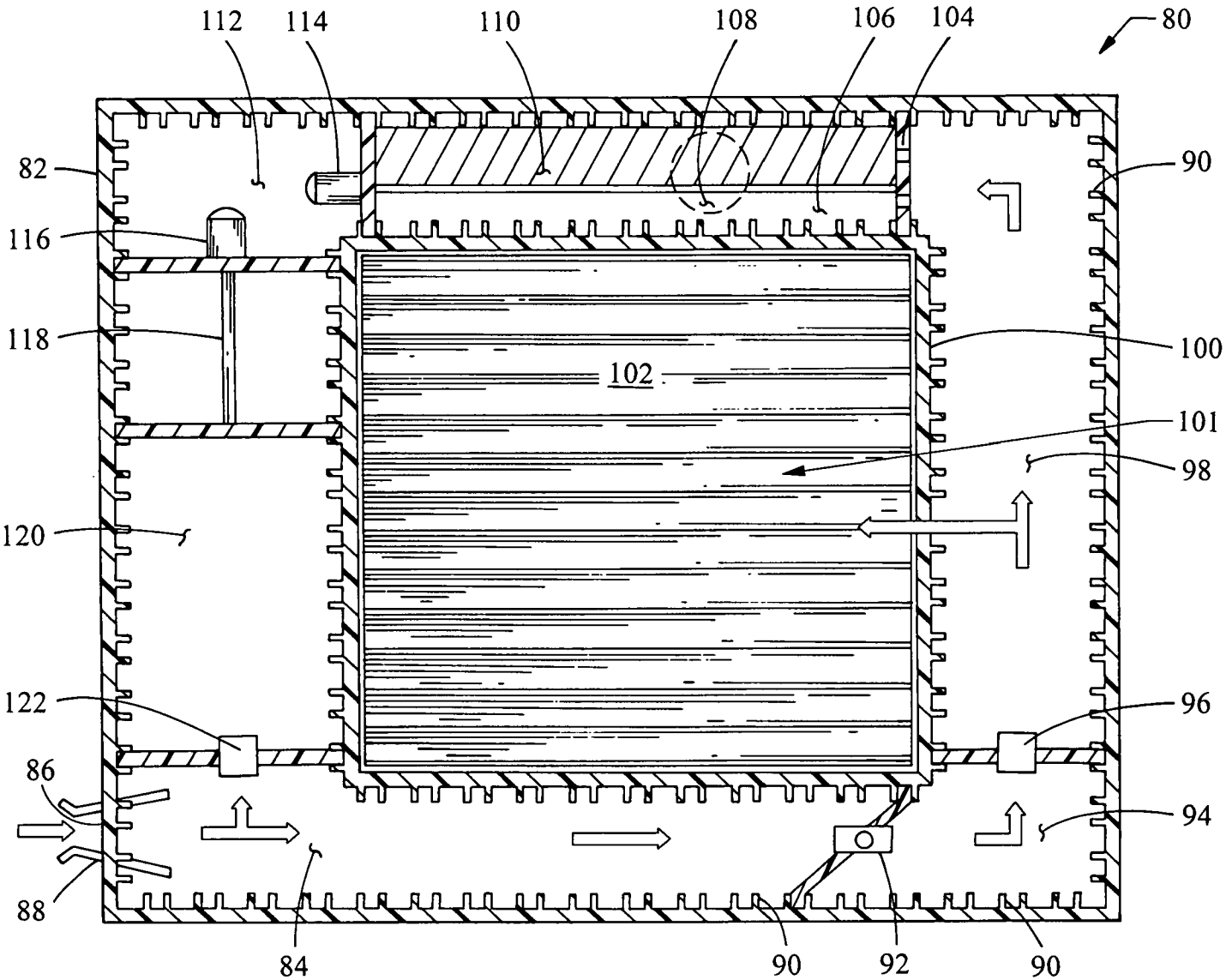
FIG. 5 is a sectional top view of another configuration of the modular air induction system shown in FIG. 2.

Now referring to FIG. 5, the resonator 80 includes a housing 82 that forms a chamber 84. An opening 86 in the housing 82 is in fluid communication with the chamber 84. The shape and volume of the chamber 84 may be varied to control the noise and air flow characteristics of the resonator. The opening 86 is located in an orifice plate 88. The orifice plate 88 may include a tube through the opening 86, as such, the size of the opening and length of the tube is sized for a desired air flow and noise control characteristics. The orifice plate 88 is interchangeable allowing different configurations for each engine package. A partition 92 is located within the chamber 84 and located by the holding members 90. The partition 92 has an opening and a tube extending from the opening. Various partitions may be used in place of partition 92 and located at additional predefined locations formed by the holding members 90. In addition, other partitions may have a different cross sectional area of opening or a different length of the tube. The partition 92 separates the chamber 84 into multiple volumes. Volume 94 is defined by the housing 82, partition 92, and partition 96. Partition 96 is a wall with an opening that is located by a set of holding members 40. However, additional sets of holding members 40 create multiple predefined positions for partition 96. The hole in partition 96 allows fluid communication between volume 94 and volume 98. Volume 98 is defined by the housing 82, partition 96, partition 100, and partition 104. Adjacent to partition 96 is a partition 100. Partition 100 is located between volume 98 and an air box 101. Partition 100 includes a plurality of perforations or holes allowing the volume 98 to be in fluid communication with air box 101. The air box 101 includes an air filter 102 which may be either a long life filter or a replaceable filter element. In addition, the air filter 102 may be treated for hydrocarbon emission control. The perforations may be varied such that the cross sectional area of individual openings or perforations may be different across the portion of partition 100 that connects volume 98 to the air box 101.

Volume 98 is also in communication with an outlet tube resonator volume 106 through holes or perforations in the partition 104. The volume of the outlet tube resonator volume 106 is defined by the housing 82, partition 104, and movable partition 110. Like partition 96, partition 104 is fixed by a set of holding members 90. In addition, multiple holding members 90 are located in predefined positions to define multiple predefined locations for the partition 104. As such, the volume of the outlet tube resonator volume 106 may be changed by moving partition 104 to another of the predefined locations, thereby changing the attenuating characteristics of the outlet tube resonator volume 106. In addition, the volume of outlet tube resonator volume 106 can be dynamically changed by movable partition 110. Movable partition 110 can be manipulated by actuator 114. Actuator 114 may be a motor configured to slide partition 110 to increase or decrease the volume of the outlet tube resonator volume 106 during vehicle use thereby dynamically changing the attenuation characteristics thereof. The actuator 114 is housed in actuator compartment 112 and connected mechanically with the movable partition 110. Further, a portion of the housing 82 or a cover (not shown) may include an opening 108 in fluid communication with the outlet tube resonator volume 106 allowing the outlet tube resonator volume 106 to be in fluid communication with an outlet tube (not shown).

Also housed in actuator compartment 112, actuator 116 is in mechanical communication with movable partition 118. Movable partition 118 is configured to dynamically change the attenuation characteristics of inlet resonator volume 120, as the movable partition 118 is manipulated by actuator 116. The volume of the inlet resonator volume 120 is defined by the housing 82, movable partition 118, and partition 122.

Partition 122 includes an opening and connector extending from the opening, thereby facilitating the fluid communication of the inlet resonator volume 120 and the chamber 84 to attenuate noise entering the inlet opening 86. As such, the partition 122 is fixed by holding members 90 that also define multiple predefined locations for partition 122.

As a person skilled in the art will readily appreciate, the above description is meant as an illustration of implementation of the principles this invention. This description is not intended to limit the scope or application of this invention in that the invention is susceptible to modification, variation and change, without departing from spirit of this invention, as defined in the following claims.

We claim:

1. An air induction system for a vehicle, the air induction system comprising:

a housing defining a chamber, the housing including an opening in fluid communication with the chamber;

a plurality of holding members attached to the housing;

a partition located within the housing to separate the chamber into a first and second volume thereby changing the attenuation characteristics of the chamber, wherein the partition is fixed within the chamber by the at least one first holding member of the plurality of holding members thereby defining a first partition location, and at least one second holding member of the plurality of holding members is adapted to receive the partition defining a second partition location.

2. The air induction system according to claim 1, further comprising:

a cover wherein the partition is located by the at least one first holding member and a cover.

3. The air induction system according to claim 1, wherein the partition includes a partition opening allowing the first volume to be in fluid communication with the second volume.

4. The air induction system according to claim 3, wherein the partition includes a plurality of openings.

5. The air induction system according to claim 3, wherein the partition includes a tube extending from the opening.

6. The air induction system according to claim 1, wherein the partition isolates the first volume from the second volume.

7. The air induction system according to claim 1, further comprising an outlet opening in fluid communication with the chamber.

8. The air induction system according to claim 1, further comprising an actuator configured to variably change the volume of the second volume.

9. The air induction system according to claim 1, further comprising an air filter located between the inlet opening and the outlet opening.

10. An air induction system for a vehicle, the air induction system comprising:

a housing defining a chamber, the housing including an opening in fluid communication with the chamber;

a plurality of holding members attached to the housing;

a partition located within the housing to separate the chamber into a first and second volume thereby changing the attenuation characteristics of the chamber, wherein the partition is fixed within the chamber by the at least one first holding member of the plurality of holding members thereby defining a first partition location, and at least one second holding member of the plurality of holding members is adapted to receive the partition defining a second partition location; and a cover wherein the partition is located by the at least one first holding member and the cover.

11. The air induction system according to claim 10, wherein the partition includes a partition opening allowing the first volume to be in fluid communication with the second volume.

12. The air induction system according to claim 11, wherein the partition includes a plurality of openings.

13. The air induction system according to claim 11, wherein the partition includes a tube extending from the opening.

14. The air induction system according to claim 10, wherein the partition isolates the first volume from the second volume.

15. The air induction system according to claim 10, further comprising an outlet opening in fluid communication with the chamber.

16. The air induction system according to claim 10, further comprising an actuator configured to variably change the volume of the second volume.

17. The air induction system according to claim 10, further comprising an air filter located between the inlet opening and the outlet opening.

* * * * *